United States Patent [19]

Plummer

[11] Patent Number: 4,799,264

[45] Date of Patent: Jan. 17, 1989

[54] SPEAKER SYSTEM

[76] Inventor: Jan P. Plummer, 5104 Afton Way, Smyrna, Ga. 30080

[21] Appl. No.: 101,395

[22] Filed: Sep. 28, 1987

[51] Int. Cl.[4] ..... H04R 7/26

[52] U.S. Cl. ..... 381/158; 181/145; 181/146; 181/163; 181/166

[58] Field of Search ..... 181/145, 144, 146, 158, 181/155, 163, 166; 381/87, 88, 90, 153, 158, 159, 161, 182, 188, 205

[56] References Cited

U.S. PATENT DOCUMENTS

| | | | |
|---|---|---|---|
| 1,882,974 | 10/1932 | Schlenker | 181/168 |
| 1,990,409 | 2/1935 | Lawrance | 181/164 |
| 2,110,908 | 3/1938 | Hartmann | 381/158 X |
| 2,256,270 | 9/1941 | Swift | 181/166 X |
| 2,761,912 | 9/1956 | Touger et al. | 181/166 X |
| 2,979,150 | 4/1961 | Irby, Jr. | 181/155 |
| 3,909,531 | 9/1975 | Plummer | 181/144 X |
| 4,029,171 | 6/1977 | Manger | 181/166 X |
| 4,119,799 | 10/1978 | Merlino | 181/144 X |
| 4,275,278 | 6/1981 | Sakursi et al. | 181/166 X |
| 4,319,098 | 3/1982 | Baitcher | 181/166 X |
| 4,387,787 | 6/1983 | King | 181/166 X |
| 4,511,768 | 4/1985 | Patel | 381/159 |

*Primary Examiner*—L. T. Hix
*Assistant Examiner*—Brian W. Brown
*Attorney, Agent, or Firm*—Jerome J. Norris

[57] ABSTRACT

A speaker system comprises a housing and at least one speaker mounted in said housing. An acoustical filter for intercepting and reradiating sound waves is mounted in front of the cone of the speaker. The acoustical filter includes a frame having a central aperture and at least one membrane mounted to the frame covering the aperture and having a resonant frequency of vibration. A plurality of slots are formed in the frame adjacent the aperture. A dispersion grid for increasing the spacial angular dispersion of sound waves generated by the speaker is mounted in front of the frame.

12 Claims, 4 Drawing Sheets

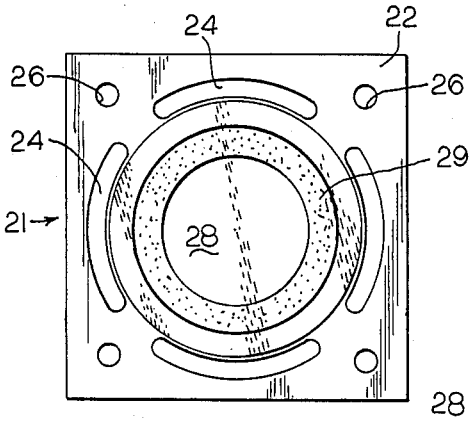
Fig 2
Fig 3
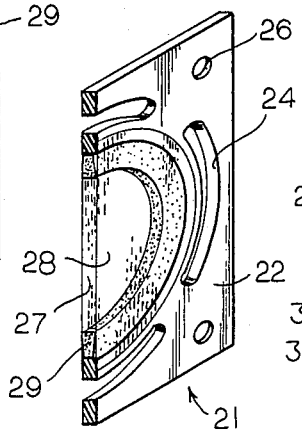
Fig 4
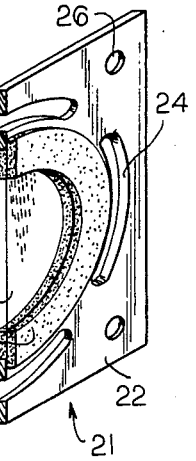
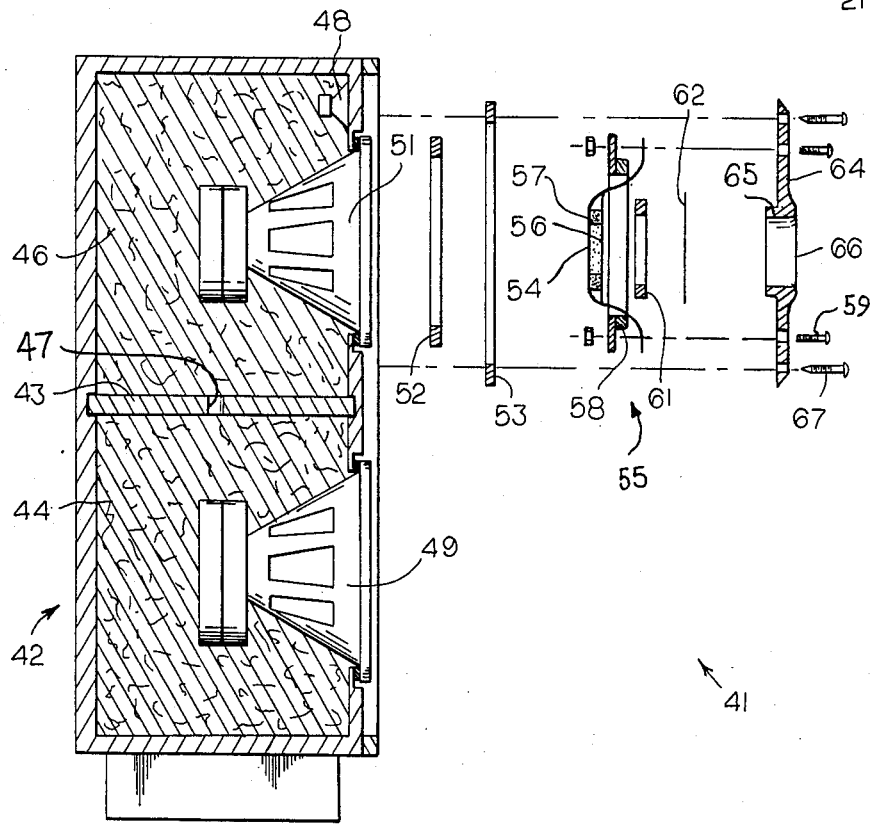
Fig 5

Fig 8 THREE-WAY SYSTEM FREQUENCY RESPONSE
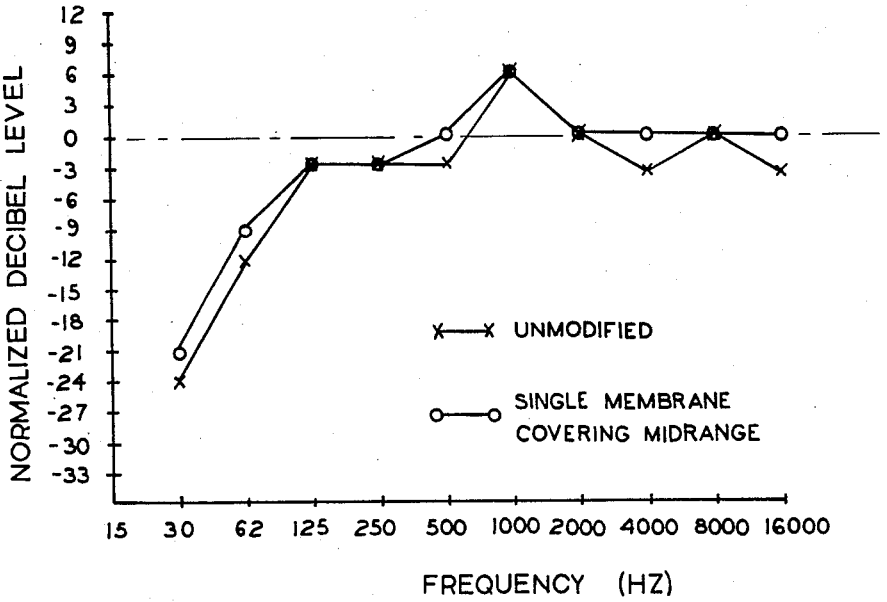

SPEAKER SYSTEM

TECHNICAL FIELD

The present invention relates generally to sound reproduction and paticularly to high fidelity speaker systems for reproducing audio frequency sounds.

BACKGROUND OF THE INVENTION

Speaker systems for reproducing recorded sounds and particularly recorded music have long been available. These systems generally comprise one or more acoustic transducers or speakers mounted in an enclosure that enhances the sounds produced by the speakers. Speaker systems are available in various sizes and designs with many having one speaker for reproducing lower and midrange audio frequencies and a second speaker for reproducing higher audio frequencies.

While prior art speaker systems are adequate reproducers of recorded sounds, certain types of audio distortion that degrade the quality of the reproduced sounds are commonly introduced by the operation of the speaker system itself. Examples of such distortions are intermodulation or IM distortion resulting from doppler frequency shifts of midrange audio frequencies produced by a speaker cone that is also producing low audio frequencies, frequency phase shift resulting from the production of sound by a non flat speaker cone or diaphragm; asymmetric propagations of sound due to different sounds being reproduced by different portions of the speaker diaphragm; and resonant "boom". Low frequency sounds can also be enhanced near the natural resonant frequency of the speaker system introducing a box like or "booming" quality into the reproduced sound. These problems can be especially acute in small so-called "book shelf" speaker systems.

Attempts have been made to reduce the audio distortions discussed above. Such attempts include acoustical loading of the speaker, varying the density of the speaker diaphragm from its center to its edges, providing slots or grooves in the speaker diaphragm, and providing speakers with flat diaphragms or membranes for reproducing sound. Examples of such attempts can be found in U.S. Pat. Nos. 4,387,787 of King, 1,882,974 of Schlenker, 1,990,409 of Lawrance, and 4,029,171 of Manger.

While some of the above attempts have improved the quality of sound reproduced by speaker systems, they have not been entirely successful because each technique typically addresses only one type of distortion and may even enhance other types.

Accordingly, it is to the provision of a speaker system that greatly reduces the types of distortion discussed above resulting in much improved reproduced sound quality that the present invention is primarily directed.

SUMMARY OF THE INVENTION

In a preferred embodiment of the present invention a speaker system comprises a small speaker cabinet, such as one having a volume of some 0.25 cubic feet, in which is mounted a first speaker for reproducing low and midrange audio frequencies and a second speaker for reproducing high audio frenquencies. The speakers are of conventional construction each having a cone that vibrates in response to electrical signals from an audio amplifier to produce sound. This general type of system is known as a two way speaker system and is commonly used in smaller or "book shelf" models.

Securely mounted in front of the first speaker is an acoustic filter comprising a substantially rigid, generally flat plate having a centrally located generally circular hole or aperture and a plurality of annularly arranged slots formed adjacent the hole periphery. A thin membrane is mounted across the hole on either side of the plate forming a sealed air pocket. Each membrane is stretched such that it has a natural resonant frequency in the range of 250 to 350 hertz. A ring of damping material is mounted within the air pocket adjacent the periphery of the circular aperture and is slightly thicker than the frame so as to be compressed slightly between the stretched membranes. Preferably, a thin dispersion grid of rigid material having a plurality of small holes is mounted to the speaker system such that it is in spaced parallel relationship with respect to the acoustic filter on the side opposite the speaker.

In operation, vibrations of the speaker cone are transmitted from the cone to the acoustic filter causing the stretched membranes of the filter to vibrate. Since a stretched membrane is difficult to drive at frequencies below its resonant frequency, the membranes are stimulated much more easily by higher frequency vibrations of the cone (above the membrane resonant frequency) than by lower frequency vibrations. The midrange and high frequency sounds, therefore, are transmitted by the membranes and the lower frequencies exit the acoustic filter through the annularly arranged slots which are sized to impede the transmission of high frequency sound therethrough. In this way, the filter acts as an acoustic crossover dividing the low audio frequencies from the midrange frequencies. Since the midrange and high frequency vibrations of the cone are directly coupled through the air to the stretched membranes, which because of limited excursion respond poorly to the lower frequency cone vibrations, the mid and high frequency sounds produced by the vibrating membranes are free of the IM distortion discussed above. At the same time the low frequencies are passed through the slots. Thus, the acoustic filter filters low frequencies from one portion of the sound waves emitted from the speaker cone while filtering high frequencies from another portion of the waves.

In addition, since the membranes are substantially flat or planar, there is no phase shift between vibrations of one part of a membrane and those of another part. Finally, asymmetric sound pressures impinging on a portion of the back membrane are transmitted through the sealed air pocket between the membranes to the entire surface of the front membrane.

In this way, asymmetric sound pressures are integrated together and transformed into a uniform motion of the front membrane. The result is a clear, widely dispersed, crisp sound with less distortion than sound produced by prior art systems.

After passing through the acoustic filter, sound waves pass through the dispersion grid which serves as an acoustical impedance through which the sound waves are introduced to the ambience. The grid dynamically loads the membrane and slot output. The membrane output is restricted slightly by the small openings of the dispersion grid and is squeezed out. The slot output passes through the grid and refracts to the edges of the grid providing acoustical output in the directions of the openings. The dispersion grid therefore serves to disperse the sound, reducing the perceived directionality often associated with smaller speaker systems.

The acoustic filter and dispersion grid may also be produced as separate articles of manufacture and used as add-on devices for existing speaker systems to reduce acoustic distortions and improve the sound quality of such systems.

BRIEF DESCRIPTION OF THE DRAWINGS

FIG. 2 is a front view of the acoustic filter in its assembled configuration.

FIG. 3 is a perspective view partially in cross-section of the acoustic filter of FIG. 2.

FIG. 4 is a perspective view partially, in cross-section, of an alternative embodiment of the acoustic filter.

FIG. 5 is a partially exploded cross-sectional view of a second embodiment of the present invention in a three way speaker system form.

FIG. 8 is a frequency response chart showing the improvement in a three way speaker system having a single membrane type filter.

DETAILED DESCRIPTION

Figure 1:
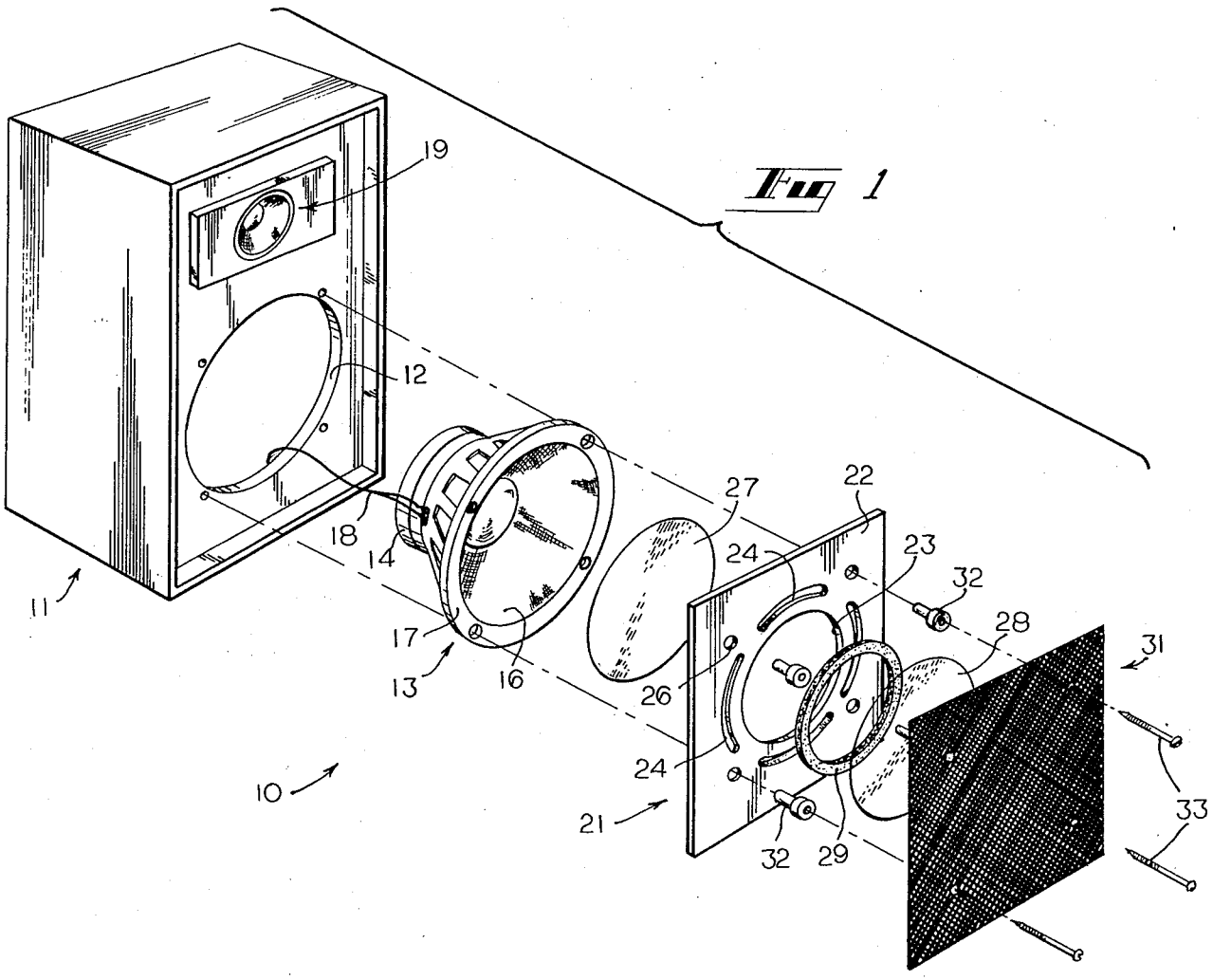
FIG. 1 is an exploded perspective view of one embodiment of the present invention.

Referring now to the figures in which like numerals represent like parts throughout the several views, FIG. 1 is an exploded view of a two-way speaker system 10 embodying principles of the present invention. It is seen to comprise a cabinet or housing 11 having a front panel in which is formed a circular opening 12 for receiving an acoustic transducer or speaker 13. The speaker of this embodiment is of a conventional type having a magnet 14 and a cone 16 which moves in response to electrical signals applied through wires 18 and is designed to reproduce both low and midrange audio frequencies.

Mounted to the mounting ring 17 of the speaker 13 is an acoustic filter 21. The acoustic filter 21 comprises a rigid flat frame 22 having a circular hole or aperture 23 centrally formed therein. Four slots 24 are formed in an annular arrangement in the frame 22 adjacent the perimeter of aperture 23. Mounting holes 26 are provided in the frame 22 for securing the frame to the cabinet. A pair of thin membranes 27 and 28 are stretched over the hole 23 on either side of the frame 22 forming an air pocket between the membranes. The peripheries of the membranes 27 and 28 are firmly attached to the frame and sealed thereto such that air cannot escape from the pocket. Mounted within the pocket and adjacent the peripheral walls of hole 23 is a damping ring 29. The damping ring is made of a soft resilient material such as urethane foam and is slightly thicker in its uncompressed state than the frame 22 so that when mounted it is compressed slightly between the stretched membranes 27 and 28.

A preferred material for the membrane is a thin, air impervious visco elastic polymer plastic such as polyvinylidene chloride produced by the Dow Chemical Company. A preferred material for the damping ring 29 is an open celled oil impregnated urethane foam. Preferably, the aperture 23 is formed with an area approximately 50% to 90% of the area of the speaker cone opening with the openings 24 having combined areas that are approximately 5% to 10% that of the speaker cone opening. The membranes 27 and 28 are stretched such that they have a natural resonant frequency of between 250 and 350 hertz, preferably about 300 hertz.

A dispersion grid 31 is mounted in front of the acoustic filter 21 and maintained in spaced, parallel relationship with respect to the acoustical filter by a set of spacers 32. The dispersion grid is constructed of a rigid material such as aluminum having a large number of small openings formed therein. The grid dynamically loads the membrane and slot output. The membrane output is restricted slightly by the small openings of the dispersion grid and is squeezed out. The slot output passes through the grid and refracts to the edges of the grid providing acoustical output in the directions of the openings. The speaker 13, acoustic filter 21, and grid 31 are all mounted to the speaker cabinet 11 with screws 33 which extend through each of these elements and into the cabinet.

FIG. 4 shows an alternate embodiment of the acoustic filter having a single membrane instead of double membranes. While this embodiment performs the acoustic crossover functions to reduce IM distortion, it does not reduce distortion caused by asymmetric vibrations because it has no air pocket through which such asymmetrys can be integrated. The single membrane embodiment of FIG. 4 therefore has been found to be less effective in reducing overall distortion than the double membrane type filter. Because of its reduced manufacturing cost, however, it may be desirable for use in lower fidelity lower cost systems in which higher distortion levels are acceptable.

The three way speaker system 41 (FIG. 5) is seen to have a cabinet 42 which is internally divided into a lower chamber 44 and an upper chamber 46 by a dividing member 43. A hole 47 is formed in the dividing member 43 allowing air communication between the chambers 44 and 46. Mounted in the lower chamber 44 is a woofer 49 for producing low frequency audio sounds. Mounted within the upper chamber is a midrange driver 51 for producing middle range audio frequencies and a tweeter 48 for producing high range audio frequencies. The woofer midrange and tweeter are of conventional construction. Examples of typical low, midrange and high frequency ranges are 20 to 300 hertz, 300 hertz to 4,000 hertz and 4,000 hertz to 20,000 hertz, respectively. The hole 47 is sized to allow passage of low frequencies produced by the woofer and to impede passage of higher frequencies produced by the midrange speaker and thus functions as a low pass filter.

Mounted in front of the midrange speaker 51 is an acoustic filter 55 having an inner membrane 54 and an outer membrane 56 separated and suspended by a damping ring 57. The membranes are securely held to a mounting plate 64 by a clamping ring 58 and screws 59. The dispersion grid provides dynamic loading for the membranes as discussed above. A tension ring 61 and a dispersion grid 62 are positioned between the cover plate 64 and the outer membrance 56 maintaining the membranes 56 and 54 in a stretched configuration. The mounting plate 64 has a circular hole 66 formed therein through which sound may escape, and an annular lip 65 against which the disperson grid 62 rests. The cover plate 64 to which the acoustic filter and grid assembly is in turn attached to the front of the midrange speaker via screws 67.

In this embodiment, there are no annularly arranged slots formed in the frame through which low frequencies can escape because low audio frequencies are produced by the woofer and not the midrange. The space between the cone of the midrange speaker 51 and the acoustic filter 55 is sealed via sealing rings 52 and 53. A preferred range for the diameter of the hole 47 has been found to be from ¼ to ½ inch.

OPERATION

As mentioned before, among the types of audio distortion present in conventional speaker systems are: (1) intermodulation or IM distortion caused by the doppler frequency shifts of higher frequency vibrations modulated on top of low frequency vibrations; (2) phase shift distortion caused by sounds being reproduced from various portions of a non flat vibrating cone; (3) asymmetric distortion resulting from various sounds being reproduced by only a small portion of the vibrating surface; and (4) resonant "boom".

In the embodiment of FIG. 1, the acoustic filter 21 covers a conventional speaker 13 and the dispersion grid 31 covers and is spaced from the acoustic filter 21. The membranes 27 and 28 are stretched across the hole 23 such that they have a particular natural resonant frequency below which they are poor transmitters of sound waves and above which they are efficient transmitters of sound waves. The membranes load the cone at frequencies above and below resonance by its mechanical resistance. However, at frequencies near and below resonance the membranes are excursion limited producing an increasing air pressure which squeezes the signal out at the edge located annular slots. The width of the slots can be varied to cause the cone loading to increase or decrease below the membrane resonance. This increased loading reduces the Q at cone resonance thereby reducing the rate of low frequency rolloff below resonance.

The annular slots are preferably continuous around the periphery of the cone allowing only adequate support area for the structure. The output of the membrane and slots is equal at and near membrane resonance.

It can thus be seen that as sound waves generated by the cone 16 of the driver 13 impinge upon the acoustic filter 21, they are divided by the filter into higher frequency sounds which are transmitted by the membranes 27 and 28 and lower frequency sounds which pass through the annular slots 24. In this way, the acoustic filter behaves as a passive acousto-mechanical crossover having an effect on acoustical signals that is somewhat analogous to the effect of a capacitive/inductive or LC filter on electrical signals with the added advantage that electronic noise and electronic phase shift is not introduced into the signal as with electrical crossovers. The mass reactance of the membranes determine the high frequency limit of the filter. Above this frequency, output is attenuated rapidly. This effectively eliminates the need for LC filtering. A 10 db reduction in the cone output is caused in the preferred embodiment at the octave above the membrane frequency.

Since the membranes 27 and 28 are coupled through the air between the acoustic filter 21 and the speaker cone 16 to only the higher frequency vibrations of the cone 16, the membranes vibrate in unison with the higher frequency vibrations of the cone thus reradiating them to the ambient atmosphere. These higher frequency sounds transmitted to the atmosphere are virtually free of IM or doppler distortion because they are not modulated on low frequency vibrations. Similarly, the low frequencies that are presented to the atmosphere through the annular slots 24 have very little higher frequency wave components because the slots are inefficient transmitters of these higher frequency sound waves. The result is that a listener may appreciate sound having smooth mellow low frequencies and clear, crisp, midrange frequencies free of IM distortion.

A second type of audio distortion that is greatly reduced by the present invention is phase distortion resulting from parts of a speaker cone being farther from a listener than other parts. In the present invention, membrane 27 is directly coupled to the speaker cone 16 through the air between the acoustic filter 21 and the cone 16. One can imagine a multitude of very small columns of air extending between each point on the membrane and the opposing point on the cone 16. As the cone 16 moves outwardly, a longer column of air near the center of the cone 16 and a shorter column of air near the periphery of cone 16 press on or influence the membrane 27 at virtually the same time. This causes the air between the membranes to be compressed forcing the outer membrane 28 to move outwardly. It can thus be seen that the outer membrane 28 moves in unison with the cone 16 of the driver 13. Since the outer membrane 28 is substantially flat rather than cone shaped, as is the speaker cone 16, parts of sound waves emitted from the center of the cone are aligned in space and time and travel together with parts emitted from the periphery of the membrane. In addition, time alignment between the cone and a surface mounted tweeter is achieved because the surface mounted acoustic filter is stimulated simultaneously with the cone 16. The result is that sounds transferred through the acoustic filter 21 and reemitted by the membrane 28 have reduced levels of phase distortion. A listener may thus hear a clearer, more coherent and more pleasing sound.

A third type of audio distortion is that resulting from asymmetric movements of the speaker cone as discussed above. If only a small portion of the inner membrane 27 moves toward the outer membrane 28, the volume of air between the membranes is compressed which causes the entire outer membrane 28 to move outwardly. Thus, asymmetric vibrations of the inner membrane 27 are integrated through the air pocket and reradiated by the outer membrane 28 as a uniform motion of the entire outer membrane. In this way, asymmetric movements of the speaker cone 16, which are transmitted to the inner membrane 27, are reradiated by the outer membrane 28 in a coherent form free of the asymmetric quality of the original movement. The listener appreciates a smoother less "raspy" quality of sound.

Finally, as the improved quality sound is transmitted and reradiated by the acoustic filter 21, it encounters the dispersion grid 31 which is spaced from the acoustic filter 21. As previously stated, the dispersion grid 31 is made of a rigid material such as aluminum and has a multitude of holes having diameters much less than the shortest wavelength sound passing through the focus grid. The dispersion grid 31 acts as an acoustical impedance through which sound waves are introduced to the ambient air. More importantly, the grid dynamically loads the membrane and slot output. The membrane output is restricted slightly by the small openings of the dispersion grid and is squeezed out. The slot output passes through the grid and refracts to the edges of the grid providing acoustical output in the directions of the openings. Without the dispersion grid, the volume of sound directly in front of the speaker system is greater than to its side. With the dispersion grid in place, the sound is more widely dispersed such that a listener may detect quality sound from virtually every location in a room.

In the embodiment of FIG. 5, low frequency sounds are produced by the woofer 49 in the lower chamber 44 and only mid-range frequency sounds are produced by the mid-range speaker 51 in the upper chamber 46. The annular slots for passing low frequencies are therefore not required here. The small hole 47 serves an important function in this embodiment. This hole acts as a low pass filter allowing low frequencies produced by the woofer to pass to the upper chamber while impeding passage of midrange frequencies from the upper chamber to the lower chamber. In this way, the woofer operates at low frequencies as if it were mounted in a cabinet with the combined volume of the upper and lower chambers and the midrange operates in a cabinet having the volume of the upper chamber alone.

A unique feature of this embodiment is that the acoustic filter 55 actually improves the bass or low frequency response of the system. Without the acoustic filter in place, if the woofer cone were to move inwardly the pressure passing through the hole 47 would cause the midrange cone to move outwardly producing a sound wave out of phase with and thus partially canceling the primary wave produced by the woofer. The membranes of the acoustic filter, however, do not respond to these low frequency vibrations and the secondary, out-of-phase wave is not produced. The result is improved bass response and resonance damping.

Figure 6:
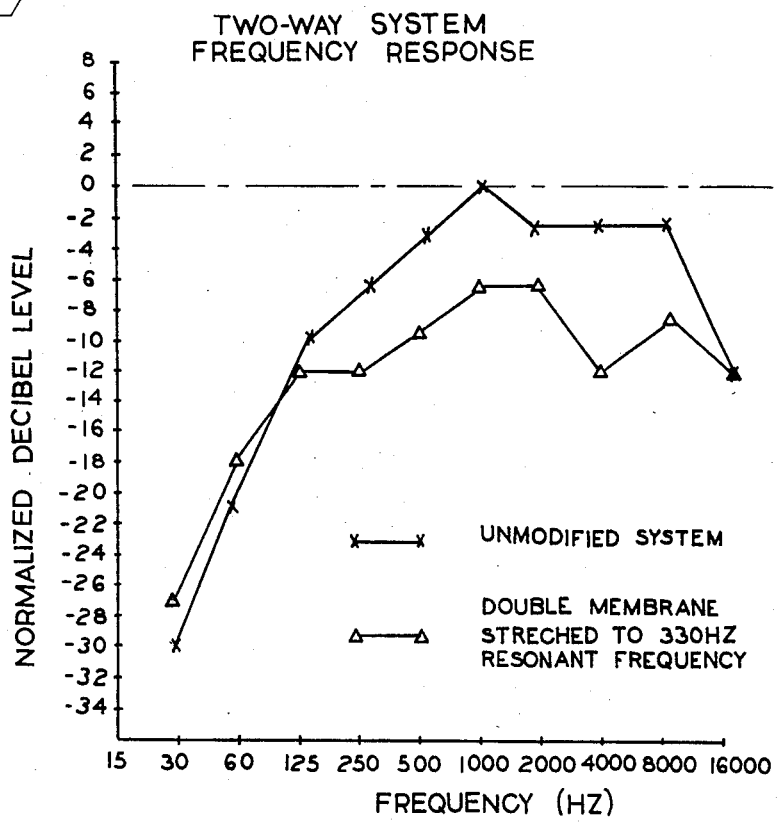
FIG. 6 is a frequency response graph showing the improvement in response of a two way speaker system embodying the present invention.
Figure 7:
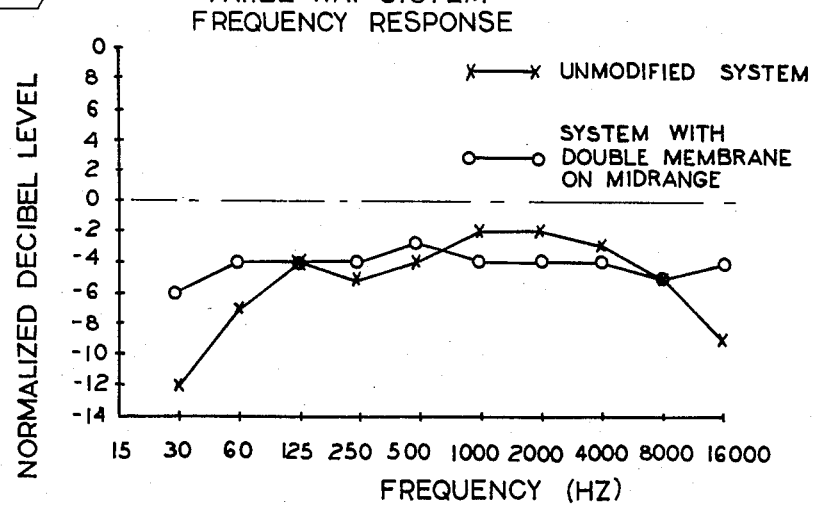
FIG. 7 is a frequency response graph showing the improvement in performance of a three way system having the embodiment of the invention shown in FIG. 5.

FIGS. 6 and 7 show comparisons of frequency response with and without the acoustical filter in place for a two-way and a three-way speaker system, respectively. An important feature of these graphs is the rate of fall-off of sound pressure level as frequency decreases. In FIG. 6, the unmodified system shows a relative drop in sound pressure level of 10 decibels from 1,000 hertz to 115 hertz whereas the system with the filter in place exhibits a drop of only 6 decibels. Similarly, the unmodified system shows a drop of 20 decibels from 125 hertz to 30 hertz whereas the system with the acoustic filter shows a 15 decibel drop. The same type measurements for the three-way system shown in FIG. 7 illustrate similar improvements.

While these measurements do not illustrate the improved sound quality as a result of reduced distortion, they do demonstrate an improved low frequency response of speaker systems that have an acoustic filter of the current invention.

It thus is seen that a speaker system of unique construction and attributes is provided that effectively reduces audio distortion resulting in improved reproduced sound quality. While preferred embodiments of the system have been described in detail, it should be understood that numerous changes, additions and deletions may be made thereto without departure from the scope of the invention as set forth in the following claims.

I claim:

1. A speaker system comprising a housing having an opening, at least one speaker including a driver and a cone responsive to said driver mounted for vibrating movement within said housing with the mouth of the cone located adjacent said housing opening whereby the driver may cause the cone to vibrate and generate sound waves having distortions inherent in sound produced by speaker cones that propagate out of the housing through the opening, and acoustical filter means mounted adjacent said cone mouth for intercepting the sound waves and reradiating them with the distortions attenuated;

wherein said filter means comprises a substantially rigid frame having an aperture formed therein and a first membrane mounted to a first side of said frame member covering said aperture;

wherein said first membrane has a resonant frequency of vibration, and wherein said speaker system further comprises means for dampening membrane vibration at said resonant frequency; and wherein said speaker system further comprises a second membrane mounted to a second side frame member covering said aperture and having a resonant frequency of vibration; said first and second membranes defining a confined air space there between and within said aperture whereby said second membrane vibrates synchronously with and in response to vibrations of said first membrane.

2. The speaker system of claim 1 wherein said aperture is substantially circular and said dampening means comprises an annular dampening ring having an outer diameter substantially corresponding to the diameter of said aperture and being mounted within said aperture adjacent the periphery thereof, said dampening ring being in direct contact with said first and second membranes.

3. A speaker system as claimed in claim 2 further comprising a plurality of slots formed in said frame member, said slots being arranged in an annular configuration about said aperture.

4. A speaker system as claimed in claim 2 further comprising means for increasing the spacial angular dispersion of sound waves reradiated by said filter means;

said dispersing means comprising a generally flat substantially rigid plate having a multitude of holes formed therethrough, said plate being mounted to said housing in spaced relation with said acoustical filter, said plate holes being sized less than the shortest wavelength sound wave producible by said speaker cone.

5. A speaker system comprising:

a housing having an opening;

at least one speaker having a driver and a cone responsive to said driver mounted for vibrating movements within said housing with the cone having a mouth located adjacent said housing opening whereby the driver may cause the cone to vibrate and generate sound waves having distortion inherent in sound produced by speaker cones, and an acoustical filter mounted adjacent said cone mouth for intercepting said sound waves and reradiating them with the distortions attenuated, said acoustical filter comprising:

(i) a substantially rigid frame member having an aperture formed therein and a plurality of slots formed therein about said aperture;

(ii) a first membrane mounted to said frame member covering said aperture, said first membrane having a resonant frequency of vibration and being adapted to intercept sound waves and to vibrate in response thereto;

(iii) a second membrane mounted to said frame member spaced from said first membrane and covering said aperture and having a resonant frequency of vibration, said first and second membranes defining a confined air pocket therebetween whereby vibrations of said first membrane may be transmitted through the air pocket to said second membrane, thereby causing the second membrane to vibrate in sympathy therewith; and (iv) dampening means mounted within said aperture in contact with said first and second membrane for damping vibrations of said first and second membranes at their resonant frequencies.

6. The speaker system of claim 5 wherein the resonant frequencies of vibration of said first and second membranes are each within the range of 250 hertz to 350 hertz.

7. The speaker system of claim 6 wherein the resonant frequency of vibration of said first and second membranes are substantially equal.

8. The speaker system of claim 5 further comprising dispersing grid means for increasing the spatial angular dispersion of reradiated sound waves, said dispersing grid means comprising a substantially rigid generally flat plate having a multitude of holes formed therethrough and mounted to said housing in spaced generally parallel relationship with respect to said acoustical filter, said holes being sized less than the shortest wavelength sound wave producable by said speaker cone.

9. An acoustic filter for filtering distortions of sounds produced by a speaker of the type having a concial diaphragm, and with the acoustic filter comprising a frame having an aperture formed centrally therein, at lease one membrane mounted to said frame covering said aperture adapted to intercept sound waves emitted by the cone and to reradiate midrange and high frequency components of the sound wave while attenuating low frequency components, and a plurality of openings formed in said frame about said aperture of a size to permit low frequency sound waves to propagate therethrough;

said filter further comprising dampening means in contact with said membrane for dampening vibrations of the membrane at the resonant frequency thereof; and said filter further comprising a second membrane mounted to said support frame covering said aperture and spaced generally parallel with said first membrane, said first and second membranes defining a confined air space therebetween.

10. The acoustical filter of claim 9 wherein said dampening means comprises a dampening ring mounted within said aperture adjacent the periphery thereof, said dampening ring being in direct contact with said first and second membranes.

11. The acoustical filter of claim 10 further comprising a dispersing grid for increasing the spatial angular dispersion of sound waves produced by vibrations of said membranes, said dispersing grid comprising a substantially rigid generally flat plate havng a multitude of holes formed therethrough and being in spaced relationship with respect to said frame, said holes being sizes less than the shortest wavelength sound wave producable by said speaker.

12. A speaker system comprising a housing having first and second apertures, a lower range speaker mounted within said housing with a cone positioned to propagate lower frequency sound through said first aperture, a higher range speaker mounted within said housing with a cone positioned to propagate higher frequency sound through said second aperture, and a baffle mounted within said housing between said first and second speakers and formed with a channel of a size to permit low frequency sound generated by said lower frequency speaker to pass while inhibiting higher frequency sounds generated by said higher frequency speaker to pass, and means for intercepting sound waves produced by said higher frequency speaker and reradiating the sound waves with acoustic distortions attenuated;

said speaker having acoustic filter means comprising a substantially rigid frame member having an aperture formed therethrough and a first membrane mounted to said frame member covering said aperture, said frame member being mounted adjacent said second aperture with said membrane arranged to intercept sound waves passing through said second aperture; and wherein said speaker system further comprises a second membrane mounted to said frame member covering said aperture and spaced from said first membrane, said first and second membranes defining an air pocket therebetween and having a resonant frequency of vibration, and means for dampening vibrations of the membranes at their resonant frequency.

* * * * *